US005676278A

United States Patent [19]

Beyer et al.

[11] Patent Number: 5,676,278

[45] Date of Patent: Oct. 14, 1997

[54] WATER DISPENSING FEED TUBE WITH IMPROVED FLOW

[75] Inventors: Philip R. Beyer, Lake Carroll; Edward H. Donselman, Freeport, both of Ill.; Richard Gordon Wells, Clinton, Iowa

[73] Assignee: Elkay Manufacturing Company, Oak Brook, Ill.

[21] Appl. No.: 430,438

[22] Filed: Apr. 28, 1995

[51] Int. Cl.[6] ..... B67D 5/00

[52] U.S. Cl. ..... 222/83.5; 222/185.1; 222/464.1

[58] Field of Search ..... 222/83, 83.5, 88, 222/185.5, 464.1

[56] References Cited

U.S. PATENT DOCUMENTS

| | | | |
|---|---|---|---|
| Re. 32,354 | 2/1987 | Savage | 222/464.1 X |
| 1,228,836 | 6/1917 | Schulse . | |
| 1,319,376 | 10/1919 | Cooper . | |
| 2,057,238 | 10/1936 | Krug | 62/143 |
| 3,892,235 | 7/1975 | Van Amerongen et al. | 128/194 |
| 4,597,423 | 7/1986 | Chenot | 141/330 |
| 4,682,187 | 7/1987 | Martner | 222/185.1 X |
| 4,793,514 | 12/1988 | Sheets | 222/67 |
| 4,846,236 | 7/1989 | Deruntz | 141/329 |
| 4,874,023 | 10/1989 | Ulm | 141/346 |
| 4,991,635 | 2/1991 | Ulm | 141/346 |
| 5,121,778 | 6/1992 | Baker et al. | 222/185.1 X |
| 5,133,482 | 7/1992 | Burrows et al. | 222/185.1 |
| 5,232,125 | 8/1993 | Adams | 222/83.5 |
| 5,413,152 | 5/1995 | Burrows | 141/18 |

*Primary Examiner*—Joseph Kaufman
*Attorney, Agent, or Firm*—Leydig, Voit & Mayer, Ltd.

[57] ABSTRACT

A hollow feed tube has a pair of generally radial openings adjacent the tip end thereof for dispensing water from an inverted bottle having a cap with an axially inwardly extending central recess. The feed tube is dimensioned to penetrate and sealingly engage the cap recess and disengage a sealing plug from the recess when the inverted water bottle is lowered onto the feed tube so as to expose the radial openings to water in the bottle. A conical diverter is disposed within the tip end of the hollow feed tube for intercepting bubbles of replacement air rising upwardly through the hollow feed tube and diverting the bubbles outwardly through one radial opening while water from the bottle flows inwardly through the other radial opening.

4 Claims, 2 Drawing Sheets

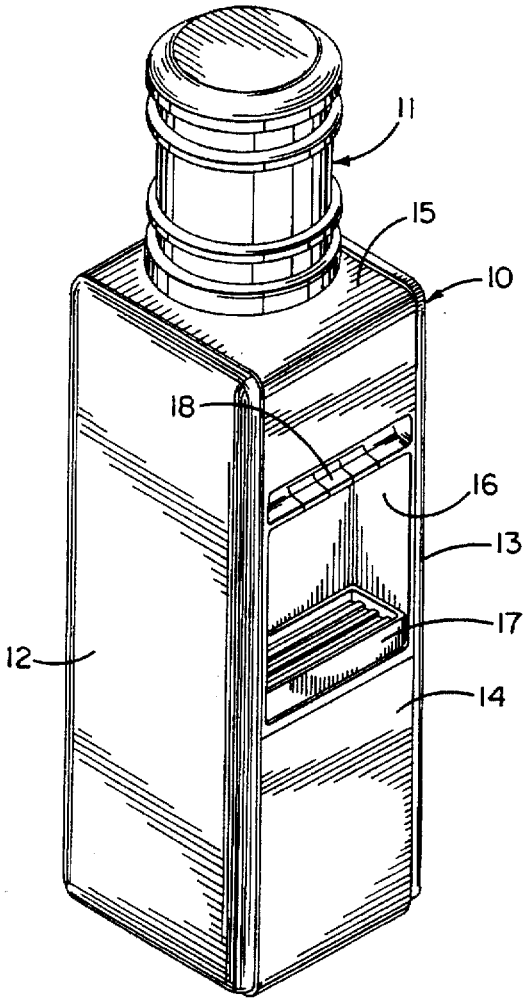
FIG. 1
FIG. 2
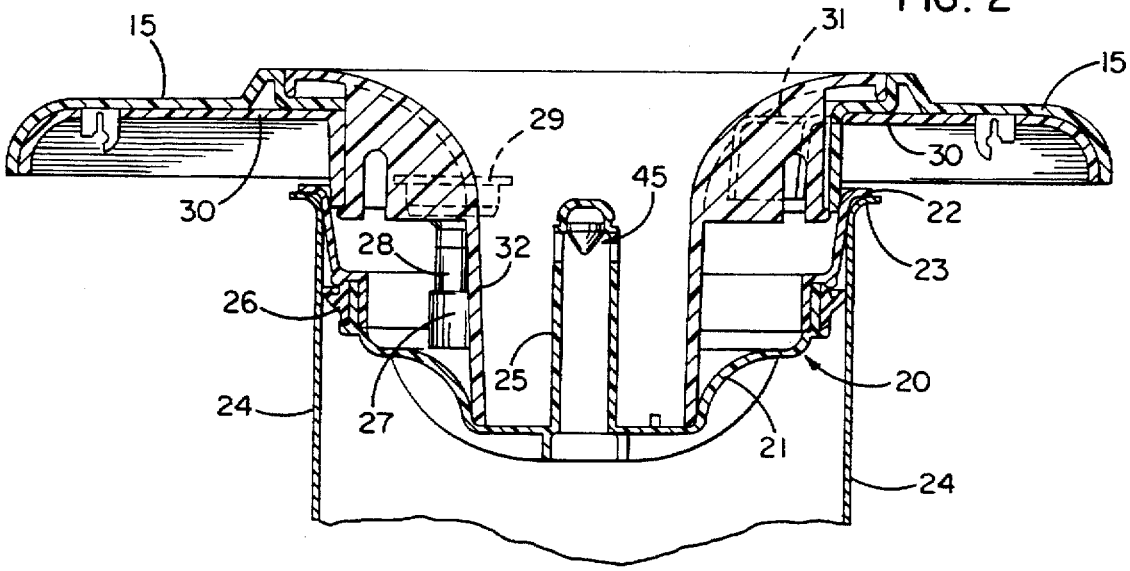

WATER DISPENSING FEED TUBE WITH IMPROVED FLOW

FIELD OF THE INVENTION

The present invention relates generally to bottled water dispensers and more particularly concerns a feed tube having improved flow characteristics for use with such bottled water dispensers.

BACKGROUND OF THE INVENTION

Bottled water dispensers have been commercially available for many years. Typically, such dispensers are designed for use with large bottles, for example on the order of five gallons or so. The bottles are filled with pure natural spring water or water that has been subjected to a commercial purifying process and then delivered to where the bottled water dispenser is located. The filled bottle is then uncapped, inverted and placed on the dispenser housing so that water flows from the bottle into a reservoir located in the dispenser housing. As the water flows out from the mouth of the bottle it causes a partial vacuum in the bottle and replacement air is drawn up through the mouth into the bottle. When the water in the reservoir rises to the level of the bottle mouth, flow stops because no more air can enter the bottle to displace the water flowing out.

In recent years, there has been a trend toward providing "no-spill" bottled water dispensers such as disclosed in Baker et al. U.S. Pat. No. 5,121,778. As shown and described in this patent, the dispenser is provided with an upstanding hollow feed tube that is disposed and dimensioned to penetrate into and through an axial recess formed centrally in the bottle cap. The cap may be of one-piece design with a hollow plug portion integrally attached to the inner end of the cap recess as is shown in Baker et al. U.S. Pat. No. 5,121,778 or the cap may be of two-piece design with the plug portion disposed telescopically within the inner end of the cap recess as is shown in U.S. Pat. No. 5,232,125 to Adams.

When such a "no-spill" type bottled water dispenser is used, it is not necessary to remove the cap from the bottle before it is inverted and placed on the dispenser. Rather, a protective seal label that covers the outer end of the cap recess is simply peeled off and then the capped bottle is inverted and lowered onto the dispenser housing. As the inverted bottle is lowered, the upstanding feed tube enters the cap recess, engages the sealing plug and separates it from the inner end of the cap recess in order to expose radial openings in the tip end of the feed tube to the water in the bottle. In the preferred arrangement, the sealing plug portion of the cap is retained on the tip end of the feed tube and when the bottle is subsequently lifted off the dispenser, the feed tube draws the plug portion back into the cap recess in sealing relation.

When a feed tube as described above and as disclosed in U.S. Pat. No. 5,121,778, is employed, replacement air from within the dispenser reservoir must pass up through the hollow feed tube as water from the bottle flows down into the reservoir. This exchange of air and water is characterized by the passage of large air bubbles rising through the feed tube and out through the radial openings in the feed tube tip. As these bubbles rise, however, they tend to impinge on the inside face of the feed tube tip where they dwell momentarily before exiting through one of the radial feed tube openings. During this brief delay in the release of each air bubble from the feed tube there is, of course, substantially no downward flow of water through the feed tube because the air bubble momentarily blocks the inflow of water. As a result, the flow of water into the reservoir is restricted and if a large volume of water is withdrawn from the reservoir into a user's receptacle, a substantial period of time is required to replenish the water in the reservoir before it can continue to flow into the user's receptacle.

OBJECTS AND SUMMARY OF THE INVENTION

Accordingly, it is the primary aim of the present invention to provide a feed tube having improved flow characteristics for use with "no-spill" type bottled water dispensers. In keeping with the invention, bubble diverting means are disposed within the tip end of the feed tube for intercepting the rising bubbles of replacement air and diverting the bubbles outwardly through one of the radial openings in the feed tube tip while another radial opening in the feed tube tip permits the free inflow of water from the bottle into the feed tube for discharge into the reservoir below. In the preferred embodiment, the bubble diverting means is in the form of an inverted conical member with a flared skirt leading out to the upper edge of the substantially rectangular shaped radial openings.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a perspective view of a bottled water dispensing unit which incorporates the feed tube having improved flow characteristics of the present invention;

FIG. 2 is a partial vertical cross section of the top portion of the dispensing unit of FIG. 1 showing the upstanding feed tube of the present invention mounted above the water receiving reservoir within the dispensing unit;

Figure 3:
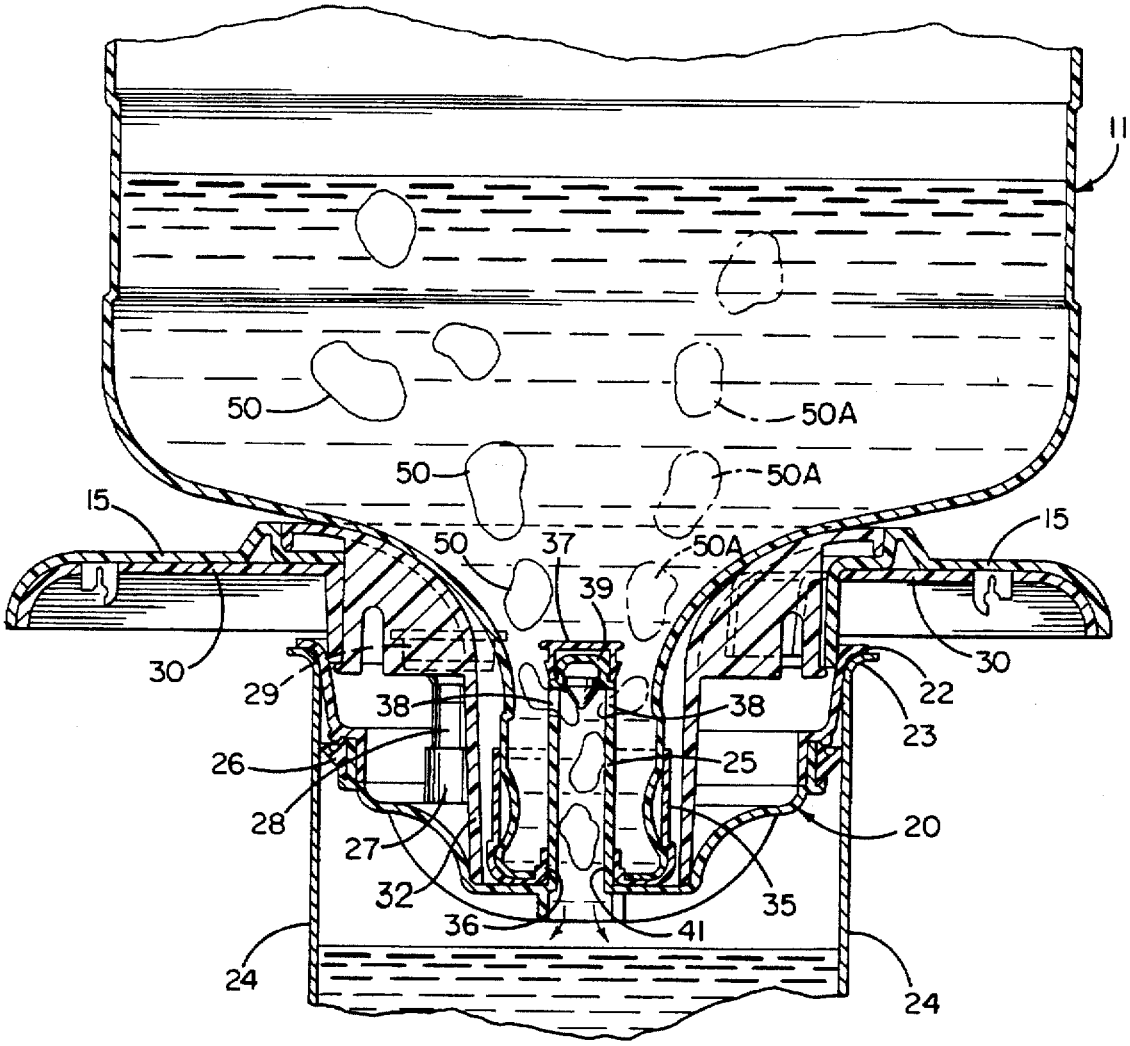
FIG. 3 is a partial cross section, similar to FIG. 2, with an inverted water bottle mounted on the dispensing unit and showing the downward flow of water and upward flow of replacement air bubbles through the hollow feed tube of the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Turning now to the drawings, there is shown in FIG. 1 a bottled water dispensing unit indicated generally at 10 supporting an inverted water bottle 11. The dispensing unit 10 has the general shape of an upstanding rectangular box including side panels 12 and 13, a front panel 14 and a top panel 15. The front panel 14 includes a recessed cavity 16 with a drip pan 17 in the bottom thereof and one or more faucet valve operating levers 18 disposed along the top edge of the cavity 16. In the preferred embodiment, the dispenser unit 10 is assembled of readily removable side panels 12 and 13 and demountable frame components such as disclosed in copending U.S. application Ser. No. 08/139,469, filed Oct. 20, 1993, which is hereby incorporated herein by reference. The dispenser unit 10 also preferably houses readily a removable reservoir, hot tank and valving components such as disclosed in U.S. Pat. No. 5,493,873, which is hereby incorporated herein by reference.

As shown in FIG. 2, the dispensing unit 10 includes a "no spill" type dispensing adapter 20 including a generally bowl-shaped mounting adapter 21 having an upper peripheral flange 22 supported on the outwardly flared upper end 23 of the water receiving reservoir 24 located within the dispenser unit 10. A hollow upstanding feed tube 25 is disposed substantially centrally in the mounting adapter 21 and as will be explained in greater detail hereinafter is dimensioned to penetrate into and sealingly engage an inwardly directed axial recess in the water bottle cap.

In the preferred embodiment, the upper end of the reservoir 24 is closed and sealed by a circumferential gasket member 26 which is carried on an intermediate side wall portion of the mounting adapter 21. A hollow boss 27 in the adapter 21 defines an air inlet opening through which replacement air may be communicated by a tube 28 from an air filter unit 29 into the space above the water in the reservoir 24.

To guide the inverted bottle and cap down into penetrating engagement with the feed tube 25, a generally funnel-shaped entry cone 32 is disposed with its lower end engaging the mounting adapter 21 and its upper end supported by the top panel 15. In the preferred embodiment, the top panel 15 is supported by a top frame piece 30 as disclosed in the aforementioned application Ser. No. 08/139,469. The mounting adapter 21 also includes a pair of flanged arms or brackets 31 which engage and are supported in recesses formed in the upper surface of the top frame piece 30 so as to suspend the mounting adapter 21 above the reservoir 24.

Referring now to FIG. 3, an inverted water bottle 11 is shown mounted and supported by the dispensing unit 10 so as to discharge water into the reservoir 24. The bottle 11 may be formed of glass or plastic material and typically has a capacity of five gallons or so. The bottle 11 is of conventional design with a generally cylindrical body merging into a downwardly and inwardly sloping shoulder and a depending neck which terminates in a mouth or discharge opening, when inverted as shown in FIG. 3. The mouth of the bottle is normally closed and sealed by a plastic cap 35 having a skirt portion and a peripheral seal which engages an external sealing bead formed on the bottle neck adjacent the mouth.

In keeping with the "no-spill" dispensing apparatus with which the present invention is associated, the bottle cap 35 is formed with an axially inwardly extending central recess 36 which is normally closed by removable sealing means such as a sealing plug 37. It will be appreciated that the sealing plug 37 may be integrally formed as an inward extension of the recess 36 such as disclosed in U.S. Pat. No. 5,121,778 or the cap may be of two-piece design with the sealing plug portion 37 disposed within the inner end of the cap recess as is shown in U.S. Pat. No. 5,232,125.

When the inverted bottle 11 and cap 35 are lowered down onto the upstanding feed tube 25, the feed tube penetrates into the cap recess 36 and engages the sealing plug portion 37 and separates it from the inner end of the cap recess 36. This exposes radial openings 38 formed in the tip end 39 of the feed tube and exposes these openings to water in the bottle. In the preferred embodiment, the tip end 39 of the feed tube includes an annular groove 40 which is adapted to receive and retain an inwardly directed annular gripping lip formed on the inside of the sealing plug portion 37. Thus the plug portion 37 is captured and retained on the tip end 39 of the feed tube after the plug portion 37 is separated axially from the cap recess 36.

Once the radial openings 38 in the feed tube tip 39, which are generally rectangular in shape, are exposed to the water in the bottle 11, the water flows inwardly into the hollow bore 41 of the feed tube 25 and is discharged down into the reservoir 24. As water flows out of the bottle 11 through the feed tube a partial vacuum is created in the space in the inverted bottle above the water. This causes air from the reservoir to be drawn through the feed tube 25 into the bottle 11 to replace the liquid that has been discharged. Typically, this replacement air passes upwardly through the feed tube in the form of a series of air bubbles. When the water from the bottle fills the reservoir up to a level where the water covers the lower end of the feed tube, the flow of water stops because no more air can enter the feed tube.

Figure 4:
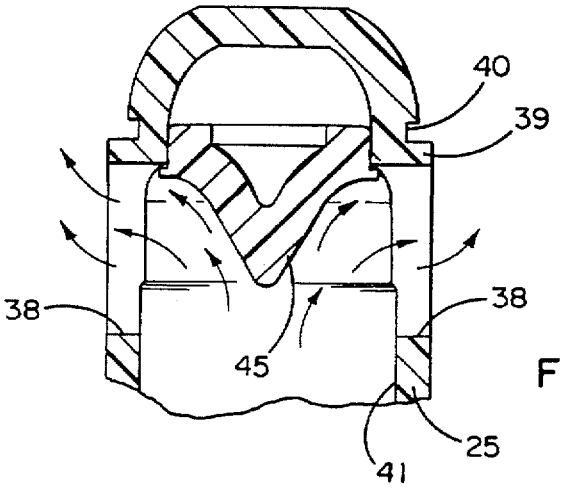
FIG. 4 is an enlarged vertical cross section of the tip end of the hollow feed tube showing the internal conical diverter for directing the flow of replacement air bubbles out through the radial openings in the feed tube tip.

In accordance with the present invention, the flow of replacement air up through the feed tube 25 and the discharge of water down through the feed tube 25 is substantially improved by providing bubble intercepting and diverting means 45 inside the tip end 39 of the feed tube 25. As shown in FIGS. 3 and 4, the bubble intercepting and diverting means 45 is substantially in the form of an inverted cone disposed in the tip end 39 of the hollow feed tube 25 adjacent the radial openings 38. Preferably, the base of the conical bubble diverting means 45 is flared outwardly and is disposed to lead outwardly at the upper edges of the radial openings which are preferably generally rectangular in shape.

As replacement air from the reservoir enters the lower end of the feed tube 25 it is formed into bubbles 50 which rise up through the hollow bore of the feed tube. When the bubbles 50 approach the tip end 39 of the feed tube they are diverted radially out through one of the radial openings 38. At the same time water from the bottle 11 flows in through the other radial opening 38 and is directed down inside the feed tube by the conical diverting means 45. The inflow of water through one radial opening 38 tends to cause the replacement air bubbles 50 to exit from the other radial opening 38 as shown by the solid line depiction of the bubbles 50 in FIG. 3. However, as one bubble rises through the feed tube, it may be closer to the other radial opening 38 than the preceding bubble that exited form the opposite radial opening. This causes the following air bubble to exit from the other opening 38, as shown by the dash line depiction of the bubbles 50A in FIG. 3. Thus, the bubbles tend to switch back and forth in a more or less random fashion sometimes exiting from one radial opening 38 and sometimes exiting through the other opening.

The conical bubble intercepting and diverter means 45 of the present invention substantially increases the flow of water through the feed tube 25. For example, the flow rates from a bottled water dispenser into a user's container were the following for one dispenser with a regular feed tube (without conical dispenser) and another dispenser with the same size feed tube including the conical dispenser of the present invention.

| Fill Time in Seconds | | |
|---|---|---|
| Cup Size | Conventional Feed Tube | Feed Tue with Diverter |
| 6 oz. | 5.0 seconds | 4.6 seconds |
| 16 oz. | 6.7 seconds | 5.7 seconds |
| 32 oz. | 48.5 seconds | 26.4 seconds |
| 60 oz. | 95.8 seconds | 54.5 seconds |

In other words, after the water was exhausted from the reservoir, the flow rate through the feed tube with the conical diverter was nearly twice as fast as the flow rate through the feed tube without the conical diverter of the present invention.

We claim as our invention:

1. A hollow feed tube having an elongated body portion, a tip end and a pair of generally radial openings adjacent the tip end thereof for dispensing water from an inverted bottle having a cap with an axially inwardly extending central recess including an inner end which is normally closed by removable sealing means, said feed tube being dimensioned to penetrate and sealingly engage said recess and disengage said sealing means from said recess when said feed tube is disposed generally vertically with said tip end up and said inverted water bottle is lowered onto said feed tube so as to expose said radial openings to water in said bottle, said elongated body portion of said hollow feed tube being undivided and substantially devoid of structural elements below said radial openings to define a common passageway for the downward flow of water from said bottle and upward flow of replacement air in the form of air bubbles, comprising means in the form of an inverted generally conical member disposed within said tip end of said hollow feed tube for intercepting said bubbles of replacement air rising upwardly through said hollow feed tube and diverting said bubbles outwardly through at least one of said radial openings into said bottle while water from said bottle flows inwardly through the other of said radial openings and downwardly through said hollow feed tube.

2. A feed tube as defined in claim 1 wherein said inverted conical member has a flared base portion disposed substantially in a plane extending through the upper edges of said radial openings.

3. A feed tube as defined in claim 1 wherein said inverted conical member is press-fit in the tip end of said hollow feed tube.

4. A feed tube as defined in claim 1 wherein said inverted conical member has an apex disposed substantially coaxially within the tip end of said hollow feed tube.

* * * * *